US009580669B2

(12) United States Patent
Van Opstal et al.

(10) Patent No.: US 9,580,669 B2
(45) Date of Patent: Feb. 28, 2017

(54) CANDLE WAX COMPRISING A POLYMER AND METHOD FOR MAKING CANDLE WAX

(71) Applicant: N-CHEMIE COMM. V., Mechelen (BE)

(72) Inventors: Niels Van Opstal, Mechelen (BE); Geert Deroover, Lier (BE)

(73) Assignee: Nchem BVBA, Mechelen (BE)

( * ) Notice: Subject to any disclaimer, the term of this patent is extended or adjusted under 35 U.S.C. 154(b) by 0 days.

(21) Appl. No.: 14/355,838

(22) PCT Filed: Nov. 7, 2012

(86) PCT No.: PCT/EP2012/072005
§ 371 (c)(1),
(2) Date: May 1, 2014

(87) PCT Pub. No.: WO2013/068385
PCT Pub. Date: May 16, 2013

(65) Prior Publication Data

US 2014/0290126 A1 Oct. 2, 2014

(30) Foreign Application Priority Data

Nov. 7, 2011 (BE) ..... 2011/0651

(51) Int. Cl.
*C10L 7/00* (2006.01)
*F23D 3/16* (2006.01)
*C11C 5/00* (2006.01)

(52) U.S. Cl.
CPC ..... *C11C 5/002* (2013.01)

(58) Field of Classification Search
CPC ..... C11C 5/002; C11C 5/004
(Continued)

(56) References Cited

U.S. PATENT DOCUMENTS 3,937,811 A * 2/1976 Papantoniou ..... A61K 8/8135 424/59
5,837,763 A * 11/1998 Ferraro ..... A61K 8/26 524/277

(Continued)

FOREIGN PATENT DOCUMENTS

CN 102061225 5/2011

OTHER PUBLICATIONS

EIC Search Dec. 4, 2015.*
Baker Petrolite Corporation "VYBAR(R) Polymers", Baker Hughes Incorporated, 2001, 1 page.

*Primary Examiner* — Pamela H Weiss
(74) *Attorney, Agent, or Firm* — Bret E. Field; Bozicevic, Field & Francis LLP

(57) ABSTRACT

This invention pertains to candle wax and a method for making candle wax. The candle wax comprises a candle wax base mixture and a polymer wherein the polymer comprises units of the formula (I) wherein X is an alkyl, alkenyl, alkyl maleic anhydride or alkylene-imine; Y is selected from the group consisting of —O—, —S—, —NH—, —$NCH_2$—, —$NCH_2CH_2$—, —COO— of which either the carbon or the oxygen group is bound to X, —C(=O)NH, trialkoxysilane, preferably trimethoxysilane or triethoxysilane, benzyl, amide group; Z is H or a $C_1$-$C_{40}$ alkyl group or a $C_1$-$C_{40}$ alkenyl group; n is a positive integer, preferably is n>3; if Y is —COO—, then the polymer is a copolymer comprising at least two different units, and if Z is H or a methyl or ethyl, than the polymer is a copolymer comprising at least one unit comprising a $C_3$-$C_{40}$ alkyl group or $C_3$-$C_{40}$ alkenyl group.

15 Claims, 1 Drawing Sheet

(58) Field of Classification Search
USPC ..... 431/288
See application file for complete search history.

(56) References Cited

U.S. PATENT DOCUMENTS

| | | | | |
|---|---|---|---|---|
| 6,471,731 | B1 * | 10/2002 | Elliott et al. | 44/275 |
| 2003/0061760 | A1 | 4/2003 | Tao et al. | |
| 2010/0205851 | A1 * | 8/2010 | Uptain | C11O 5/008<br>44/275 |
| 2010/0212214 | A1 | 8/2010 | Wu et al. | |

* cited by examiner

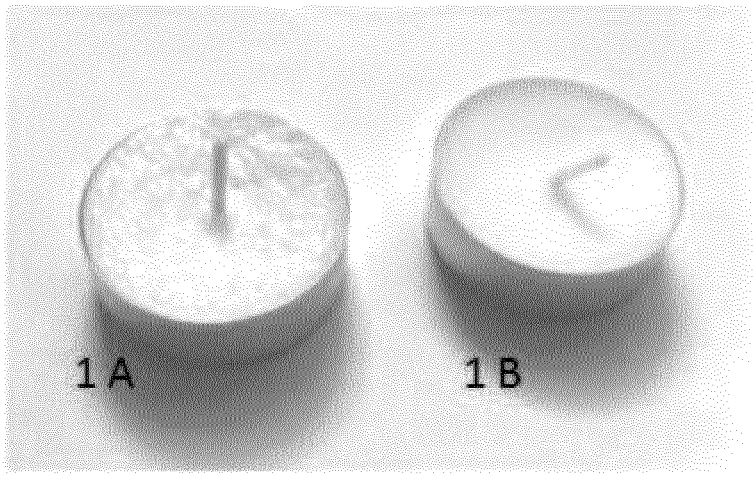
1A
1B

CANDLE WAX COMPRISING A POLYMER AND METHOD FOR MAKING CANDLE WAX

This invention is related to a candle wax and a method of making candle wax.

Candles are made from candle wax. Candle wax is either made from a range of waxy substances derived from insects, or it is produced from fatty acids derived from animal fats and plant oils. Candle wax is also often produced from substances derived from petroleum, such as paraffin. Mixtures of differing types of waxes obtained from various sources are also used where the proportions of differing waxes can vary.

A disadvantage of using candle wax produced from fatty acids derived from animal or plant sources is that the candle wax can crystallise during solidification. Candles produced from this type of wax burn well, but paraffin is often added to such candles because the surface of the candle is experienced by the consumer as having a raw surface and has therefore less esthetic value. Paraffin wax is a mixture of alkanes where the number of carbon in the chains is between 20 and 40. Paraffin ensures that the fatty acids do not crystallise during solidification and that the cooled wax has a flat surface that feels smooth and not rough. Typically 10-30% paraffin is added to achieve a good anti-crystallisation effect. Paraffin is a relatively expensive product that is mainly derived from petroleum which causes the price of paraffin to fluctuate greatly depending on the market. In addition, a large amount of paraffin is needed to obtain an anti-crystallisation effect.

An alternative product is therefore needed that is both easy to manufacture and cheap, and also ensures that the fatty acids, and therefore the candle wax, do not crystallise.

Therefore it is an object of this invention to provide a candle wax that does not crystallise during solidification or one that minimizes the crystallisation of the candle wax so that crystals are no longer visible.

Another object of this invention is to provide a candle wax that is easily obtainable where only a small amount needs to be added to obtain a crystallisation-reducing effect.

These objects, amongst other objects, are at least partially, if not completely, met by a candle wax as specified in claim 1.

These objects are achieved in particular by a candle wax comprising a mixture of candle wax base and a polymer where the polymer comprises units having the formula (I):

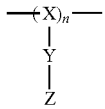

(I)

X is an alkyl, alkenyl, alkyl maleic anhydride or alkylene-imine;

Y is selected from the group consisting of —O—, —S—, —NH—, —$NCH_2$—, —$NCH_2CH_2$—, —COO— of which either the carbon or the oxygen group is bound to X, —C(=O)NH, trialkoxysilane, preferably trimethoxysilane or triethoxysilane, benzyl, amide group;

Z is H or a $C_1$-$C_{40}$ alkyl group, branched or unbranched, or a $C_1$-$C_{40}$ alkenyl group, branched or unbranched;

n is a positive integer, preferably is n>3; and if Y is —COO—, then the polymer is a copolymer comprising at least two different units.

The inventor has surprisingly found that a candle with the above mentioned properties does not form crystals when solidifying, or crystallisation in the candle wax was reduced to such a degree that the crystals were no longer visible.

A candle wax, according to this invention, comprising a polymer having the formula (I) that ensures that molecules in candle wax, which mainly comprise C16 and C18 saturated fatty acids, do not have the possibility to orderly arrange themselves. The polymer according to the invention hinders long fatty acid chains from neatly arranging themselves next to each other, so that a disorderly arrangement results. This results in candles that form few or no crystals and candles that feel smooth on the surface. By adding a polymer according to formula (I), crystallisation is reduced to such a degree that the crystals are no longer visible with the naked eye.

The candle wax base, according to this invention, comprises wax prepared from various sources such as animal fat, petroleum, plant oils (such as palm and soy oil), and synthetic sources. The candle wax base can be produced from one single source, but can also be made from a mixture of two or multiple sources. The candle wax base principally comprises fatty acids and preferably has a fatty acid composition of more than 90%, more preferably more than 95%, and even more preferably more than 98% and can have a composition of up to approximately 99.998%. The most commonly occurring fatty acids in the candle wax base are C16 and C18 fatty acids (i.e. palmitic acid and stearic acid, saturated or unsaturated). Most of the fatty acids found in the candle wax base are saturated fatty acids. The composition of the candle wax base is solid at room temperature and has a melting point higher than 40° C. This invention preferably is related to a candle wax base composition, as described by this invention, that crystallises during solidification without the addition of a polymer.

"Alkyl" is, according to this invention, a group of hydrocarbons that are composed of only single-bonded carbon and hydrogen atoms.

"Alkenyl" is, according to this invention, a group of hydrocarbons that have a single double-bond.

"Random copolymer" is, according to this invention, a polymer derived from two or more monomers. The sequence of monomer residues in a random copolymer are randomly distributed according to a statistical rule where the chance of finding a monomer residue in the polymer is equal to the molar fraction of the monomer residue in the chain. The random copolymer, according to this invention, has multiple monomers of units according to formula (I) that have a different X, Y or Z-group.

In a particular embodiment, according to this invention, X is selected from the group consisting of ethyl, 1-propyl, 2-propyl, 1-butyl, 2-butyl, 3-butyl, 2-methyl-1-propyl, 1-methyl-1-propyl, 2-methyl-2-propyl, pentyl, methylbutyl, 2-methylbutyl, methyl maleic anhydride, ethyl maleic anhydride or alkylene-imine, preferably ethylene-imine;

Y is selected from the group consisting of —O—, —S—, —NH—, —$NCH_2$—, —$NCH_2CH_2$—, —COO— of which either the carbon or the oxygen group is bound to X, —C(=O)NH—, trialkoxysilane, preferably trimethoxysilane or triethoxysilane, benzyl, amide group;

Z is hydrogen, methyl, a $C_{10}$-$C_{40}$ saturated alkyl, preferably unbranched and is preferably a $C_{14}$ (i.e. n-tetradecyl-group), $C_{16}$ (i.e. n-hexadecylgroup), $C_{18}$ (i.e. n-octadecyl-group), $C_{20}$ (i.e. n-icosylgroup), or $C_{22}$ (i.e. n-doicosylgroup) alkyl group, wherein n is a positive integer that is larger than 3.

In a particular embodiment, the polymer is a random copolymer. The random copolymer has a formula according to (II) or (III):

(II)

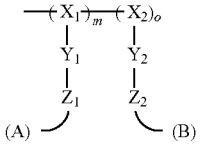

(III)

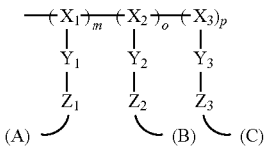

wherein the polymer comprises a first unit (A), and a second unit (B), or a further third unit C, wherein each of $X_1$, $X_2$ or $X_3$ is selected from the group consisting of ethyl, 1-propyl, 2-propyl, 1-butyl, 2-butyl, 3-butyl, 2-methyl-1-propyl, 1-methyl-1-propyl, 2-methyl-2-propyl, pentyl, methylbutyl, 2-methylbutyl, ethyl maleic anhydride or alkylene-imine, preferably ethylene-imine;

each of $Y_1$, $Y_2$ or $Y_3$ is selected from the group consisting of —O—, —S—, NH—, —$NCH_2$—, —$NCH_2CH_2$—, —COO— of which either the carbon or the oxygen group is bound to X, —C(═O)NH—, trialkoxysilane, preferably trimethoxysilane or triethoxysilane, benzyl, amide group;

each of $Z_1$, $Z_2$ or $Z_3$ is hydrogen or a $C_1$-$C_{40}$ alkyl group or a $C_1$-$C_{40}$ alkenyl group, preferably hydrogen, methyl, ethyl or a $C_{10}$-$C_{40}$ saturated alkyl, preferably unbranched, and is preferably a $C_{14}$, $C_{16}$, $C_{18}$, or $C_{20}$ alkyl group;

wherein m, o and p are positive integers, and m+o>3, or m+o+p>3; and if $Y_1$ of unit A is —COO—, then is unit B and/or C different from unit A and if $Z_1$ is H or a methyl or ethyl, than is $Z_2$ and/or $Z_3$ a $C_3$-$C_{40}$ alkyl group or $C_3$-$C_{40}$ alkenyl group.

In a preferred embodiment, the polymer has a formula according to formula (III), where $X_2$ and $X_3$ are methyl, $Y_2$ and $Y_3$ are —COO— with the C atom bound to $X_2$ and $X_3$. In this embodiment the polymer is obtainable by the polymerization of a mixture of a (di)alkyl maleate with another subunit.

In an embodiment, the first unit (A) has a weight ratio of 0-100% w/w, or 0-99% w/w, or 1-100% w/w in relation to the total amount of polymer, preferably 20-100% w/w, more preferably 50-100% w/w and most preferably about 70% w/w.

In a different embodiment, the second unit (B) and/or the third unit (C) have together or apart a weight ratio of 0-100% w/w, or 0-99% w/w, or 1-100% w/w in relation to the total polymer, preferably between 0 and 80% w/w, more preferably 0-50% w/w, and most preferably about 30% w/w.

A skilled person will understand that the composition of the units in the polymer can vary, and that an optimal result is achieved depending on the fatty acid base that one wants to use for producing candle wax.

In a particular embodiment the random copolymer is, according to this invention, produced from vinyl ether monomers where $Z_1$ is an unbranched C16 alkyl and $Z_2$ is an unbranched C18 alkyl group. These polymers have the following structural formula (IV):

IV

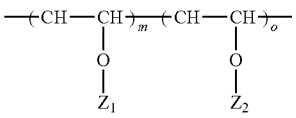

wherein unit (A) $Z_1$ is a C16 unbranched n-hexadecyl group and unit (B) $Z_2$ is an unbranched C18 n-octadecyl group; and m and o are a positive integer and independent of each other, where the sum of m and o is greater than 3.

As described above, the weight ratio of the units in the polymer is dependent on the composition of the candle wax base. A candle wax base that contains approximately 70% C16 fatty acid and approximately 30% C18 fatty acid has a better effect than if the polymer has about 70% w/w of unit A, where $Z_1$ is a C16 alkyl group and has about 30% w/w of unit B, where $Z_2$ is a C18 alkyl group.

In yet another embodiment, the copolymer is selected from the group consisting of poly(ethenyl hexadecyl ether); poly(ethenyl octadecyl ether); poly(1-propenyl hexadecyl ether); poly(1-propenyl octadecyl ether); poly(2-propenyl hexadecyl ether); poly(2-propenyl octadecyl ether); poly(1-butenyl hexadecyl ether); poly(1-butenyl octadecyl ether); poly(2-butenyl hexadecyl ether); poly(2-butenyl octadecyl ether); poly(3-butenyl hexadecyl ether); poly(3-butenyl octadecyl ether); poly(2-methyl-2-propenyl hexadecyl ether); poly(2-methyl-2-propenyl octadecyl ether); poly(2-methyl-1-propenyl hexadecyl ether); poly(2-methyl-1-propenyl octadecyl ether); poly(1-methyl-2-propenyl hexadecyl ether); poly(1-methyl-2-propenyl octadecyl ether); poly (ethenyl hexadecyl/octadecyl ether); poly(1-propenyl hexadecyl/octadecyl ether); poly(2-propenyl hexadecyl/octadecyl ether); poly(1-butenyl hexadecyl/octadecyl ether); poly (2-butenyl hexadecyl/octadecyl ether); poly(3-butenyl hexadecyl/octadecyl ether); poly(2-methyl-2-propenyl hexadecyl/octadecyl ether); poly(2-methyl-1-propenyl hexadecyl/octadecyl ether); poly(1-methyl-2-propenyl hexadecyl/octadecyl ether; poly(vinyl alkyl ether), poly(vinyl alkyl ether-maleic anhydride)copolymer, poly(vinyl alkyl ether-(di)alkyl maleate) copolymer, poly(vinyl alkyl ether-(di)alkyl maleate-vinyl trialkoxysilane copolymer, poly(vinyl alkyl ether)-vinyl trialkoxysilane copolymer, poly(vinyl acetate-(di)alkyl maleate)copolymer, poly(vinyl acetate-(di)alkylmaleate-trialkoxysilane) copolymer, polystyrene-(di)alkyl maleate copolymer, poly(alkanoyl ethylene-imine), poly(alkyl acrylamide), poly(ethylene-(di)alkyl maleate copolymer), poly(propylene (di)alkyl maleate copolymer), poly(butylene (di)alkyl maleate) copolymer, poly (ethylene-(di)alkyl maleamide copolymer), poly(propylene-(di)alkylmaleamide copolymer), poly(butylenes)-(di)alkyl maleamide) copolymer.

In another embodiment, the polymer has a molecular weight of between 1 and 1000 kDa (kiloDalton), preferably between 5 and 500 kDa, more preferably between 5 and 350 kDa, even more preferably between 30 and 350 kDa, and most preferably between 50 and 200 kDa.

In yet another embodiment, the candle wax comprises a mixture of candle wax base with the polymer wherein the polymer has a proportion of 10 to 2000 ppm (parts per million), preferably between 50 and 1000 ppm, more preferably between 100 and 500 ppm, and most preferably between about 150 and 300 ppm in relation to the candle wax base. The inventor has surprisingly found that such small quantities can have an anti-crystallisation effect on the candle wax base.

In a second aspect of this invention, the candle wax as described in this invention can also be used to make candles, e.g. such as tealights. A tealight is a candle with a metal shell that surrounds the candle wax on the bottom and side. Tealights are mainly produced from fatty acids obtained from animal or vegetable sources, or a mixture of different fatty acids. The candle wax base comprises mainly C16 (palmitate or palmitic acid) and C18 (stearic acid or stearate) fatty acids. Adding the polymer, according to the invention, ensures that crystallisation is prevented in the candle wax base and that visible crystals are not formed.

In yet another aspect, the invention relates to a method for making candle wax comprising mixing a candle wax base of animal or vegetable origin and/or a candle wax base which is produced from petroleum where the polymer comprises units having the formula (I):

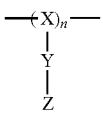

(I)

wherein

X is an alkyl, alkenyl, alkyl maleic anhydride or alkylene-imine;

Y is selected from the group consisting of —O—, —S—, —NH—, —$NCH_2$—, —$NCH_2CH_2$—, —COO— of which either the carbon or the oxygen group is bound to X, —C(═O)NH—, trialkoxysilane, preferably trimethoxysilane or triethoxysilane, benzyl, amide group;

Z is H or a $C_1$-$C_{40}$ alkyl group or a $C_1$-$C_{40}$ alkenyl group;

n is a positive integer, preferably is n>3;

if Y is —COO—, then the polymer is a copolymer comprising at least two different units; and if $Z_1$ is H or a methyl or ethyl, than is $Z_2$ and/or $Z_3$ a $C_{10}$-$C_{40}$ alkyl group or $C_3$-$C_{40}$ alkenyl group.

In an embodiment the invention comprises a method wherein wherein

X is selected from the group consisting of ethyl, 1-propyl, 2-propyl, 1-butyl, 2-butyl, 3-butyl, 2-methyl-1-propyl, 1-methyl-1-propyl, 2-methyl-2-propyl, pentyl, methylbutyl, 2-methylbutyl, methyl maleic anhydride, ethyl maleic anhydride or alkylene-imine, preferably ethylene-imine;

Y is selected from the group consisting of —O—, —S—, NH—, —$NCH_2$—, —NCH2CH2-, —COO— of which either the carbon or the oxygen group is bound to X, C(═O)NH, trialkoxysilane, preferably trimethoxysilane or triethoxysilane, benzyl, amide group;

Z is hydrogen, methyl or a C10-$C_{40}$ alkyl group, preferably unbranched and is preferably $C_{14}$, $C_{16}$, $C_{18}$, $C_{20}$ or $C_{22}$ alkyl group, wherein n>3.

In another embodiment, the invention comprises a method where the polymer is a random copolymer.

In yet another embodiment, the invention comprises a method wherein the polymer is a random copolymer, comprising a structure according to formula (II) or (III):

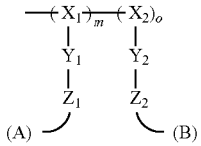

(II)

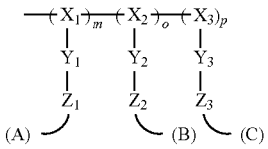

(III)

wherein the polymer comprises a first unit (A), and a second unit (B), or a further third unit C, wherein each of $X_1$, $X_2$ or $X_3$ is selected from the group consisting of ethyl, 1-propyl, 2-propyl, 1-butyl, 2-butyl, 3-butyl, 2-methyl-1-propyl, 1-methyl-1-propyl, 2-methyl-2-propyl, pentyl, methylbutyl, 2-methylbutyl, ethyl maleic anhydride or alkylene-imine, preferably ethylene-imine;

each of $Y_1$, $Y_2$ or $Y_3$ is selected from the group consisting of —O—, —S—, —NH—, —$NCH_2$—, —$NCH_2CH_2$—, —COO— of which either the carbon or the oxygen group is bound to X, C(═O)NH, trialkoxysilane, preferably trimethoxysilane or triethoxysilane, benzyl, amide group;

each of $Z_1$, $Z_2$ or $Z_3$ is hydrogen or a $C_1$-$C_{40}$ alkyl group or a $C_1$-$C_{40}$ alkenyl group, preferably hydrogen, methyl, ethyl or a $C_{10}$-$C_{40}$ saturated alkyl, preferably unbranched, and is preferably a $C_{14}$, $C_{16}$, $C_{18}$, or $C_{20}$ alkyl group;

wherein m, o and p are positive integers, and m+o>3, or m+o+p>3;

if $Y_1$ of unit A is —COO—, then is unit B and/or C different from unit A; and if $Z_1$ is H or a methyl or ethyl, than is $Z_2$ and/or $Z_3$ a $C_{10}$-$C_{40}$ alkyl group or $C_3$-$C_{40}$ alkenyl group.

In yet another embodiment, the invention comprises a method where the first unit (A) has a weight ratio of 0-100% w/w, or 0-99% w/w, or 1-100% w/w, preferably between 20-100% w/w, more preferably between 50-100% w/w, and most preferably about 70% w/w.

In yet another embodiment, the invention includes a method where the second unit (B) and/or third unit (C) has a weight ratio of 0-100% w/w, or 0-99% w/w, or 1-100% w/w, preferably between 0 to 80% w/w, more preferably with a 0-50% w/w, and most preferably approximately 30% w/w.

In yet another embodiment, the invention comprises a method in which the polymer has a molecular weight of between 1 and 1000 kDa, preferably between 5 and 500 kDa, more preferably between 30 and 350 kDa, and most preferably between 50 and 200 kDa.

In yet another embodiment, the invention comprises a method in which the polymer is between 10 to 2000 ppm, preferably between 50 and 1000 ppm, more preferably between 100 and 500 ppm, and most preferably about between 150 and 300 ppm, and is mixed with the candle wax base.

In yet another embodiment, the invention comprises a method in which the mixing of the polymer and the candle wax base is carried out at a temperature at which the polymer and the candle wax base are in the liquid phase. This is done mainly at a temperature between 40° C. and 100° C., preferably between 50° C. and 70° C.

In yet another embodiment, the invention includes a method that comprises the casting of the candle wax into a mould, where the candle wax is solidified by, for example, letting the entire mass cool at room temperature.

In yet another embodiment, the invention comprises a method for filling a mould with candle wax in powder form or in granule form, as described by the invention, after which the granulate or powder is consolidated under high pressure.

In this aspect the technical effects and advantages of the various embodiments of the method of the invention correspond mutatis mutandis to those described above in connection with the products according to the invention.

The invention is further illustrated by the examples and the FIGURE. A skilled person will understand that these examples are in no way limiting for the invention as described above.

DESCRIPTION OF FIGURE

FIG. 1A shows a tealight made from a base derived from palm fatty acid, and FIG. 1B shows a tealight made of a mixture of fatty acid derived from palm base mixed with 150 ppm of polymer having the formula (III).

EXAMPLES

Example 1

Preparation of polyethenyl-hexadecylether/polyethenyl-octadecylether

The random copolymer polyethenyl-hexadecylether/polyethenyl-octadecylether was prepared via a free radical polymerization reaction of vinyl ethers:

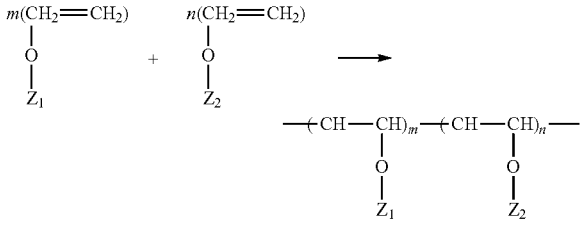

wherein $Z_1$ is an unbranched C16 alkyl, or is palmityl or hexadecyl, and $Z_2$ is an unbranched C18 alkyl, or is stearyl or octadecyl, and m and o are a positive integer, whose sum is greater than 3.

To obtain a yield of polymers with a high average molecular weight, the polymerization of the long chain alkyl vinyl ethers was performed under acidic conditions. The appropriate acid or photo acid was mixed with monomers and the reaction was followed with (FT)IR spectroscopy until the vinylic double bonds almost completely disappeared from the IR absorption spectra. By adjusting the reactant ratios, the molecular weight and the composition can be tuned.

A skilled person will understand that such polymerization can be carried out in various ways.

Example 2

Preparation of poly(vinyl alkyl ether-maleic anhydride copolymer) and poly(vinyl alkyl ether-(di)alkyl maleate copolymer)

In a typical radical polymerization reaction of maleic anhydride with long chain vinyl ethers, the components are dissolved in an inert solvent (up to 60%) under inert atmosphere and cured by a thermal or a photochemical initiator until the typical double bond IR absorption bands almost completely disappeared from the IR absorption spectra of the reaction mixture. By adjusting the amount of initiator, the molecular weights of the polymers can be tuned. This then provides a poly(vinyl alkyl ether-maleic anhydride copolymer).

To prepare poly(vinyl alkyl ether-(di)alkyl maleate copolymer), or poly(vinyl alkyl ether-(di)alkyl maleamide copolymer), the poly(vinyl alkyl ether-maleic anhydride copolymer) polymer as obtained above, is than reacted with long chain aliphatic alcohols or amines to yield the desired products (conventional synthetic protocols for the formation of esters and amides are used). The reaction are followed by (FT)IR spectroscopy (disappearance of the acid and anhydride absorption bands and formation of ester and amide bands). The reactions are shown below.

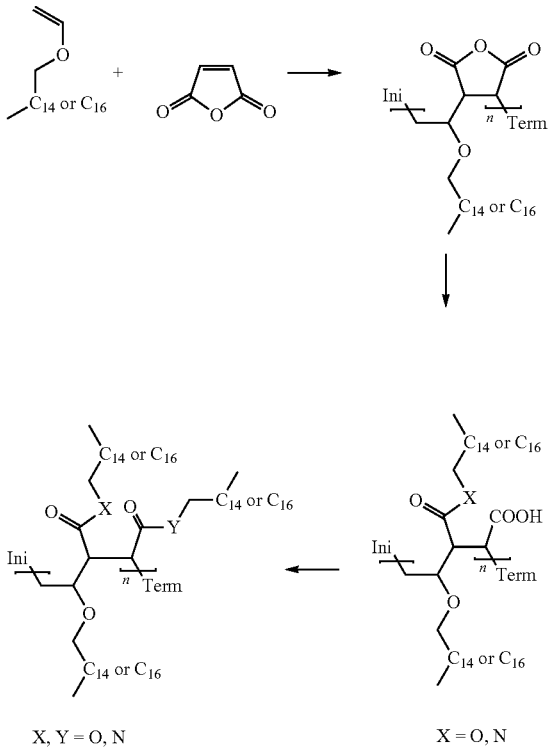

Example 3

Preparation of poly(alkyl acrylamide) and copolymer poly(vinyl alkyl ether-alkyl acrylamide)

In a typical radical polymerization reaction of acrylamides with or without long chain vinyl ethers, the components are dissolved in an inert solvent (up to 60%) and cured by a thermal or a photochemical initiator until the typical double bond IR absorption bands almost completely disappeared from the IR absorption spectra of the reaction mixture. By adjusting the amount of initiator the molecular weights of the resulting polymers can be tuned.

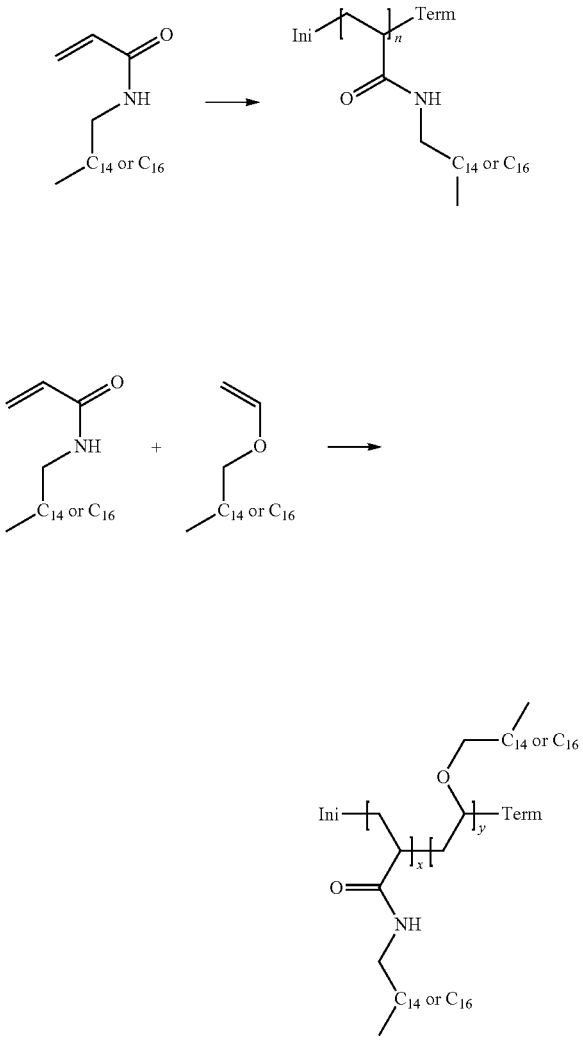

Example 4

Preparation of poly(alkyl acrlyamide) via polycondensation reaction and poly(alkanoyl ethylene-imine)

In a typical polycondensation reaction, the acid and the amine are mixed in appropriate amounts (up to equimolar ratios of the amine and the acid) and heated to 150° C. under a nitrogen flow (to remove the water) for about 6 hours. The course of the reaction is followed by (FT)IR spectroscopy (disappearance of the acid and the salt absorption bands and formation of the secondary and tertiary amide bands). Depending on the molecular weight of the polyacrylic acid or polyethylenimine and the charge of long chain aliphatic amines or long chain aliphatic acids the molecular weight of the resulting polymer can be tuned.

The reaction is as follows:

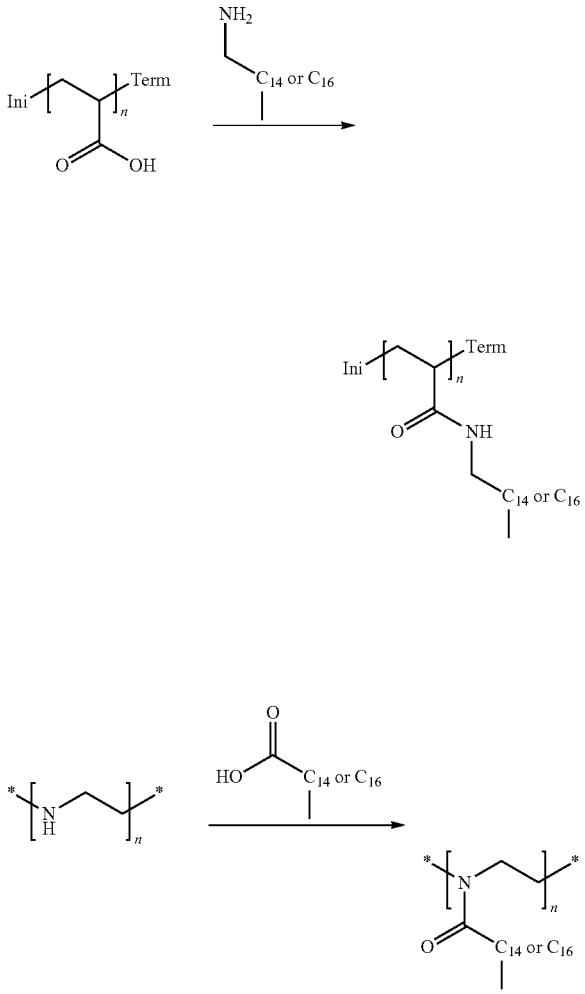

Example 5

Preparation of Candle Wax

Different types of candle wax are prepared in which the composition of the candle wax base and also the ratio of the units in the copolymer can vary. Table 1 shows the results of the effect of anti-crystallisation. The effect of anti-crystallisation is displayed as −−: poor anti-crystallisation effect, many crystals present in candle wax, −: mild anti-crystallisation effect, many crystals present in candle wax, +/−: average anti-crystallisation effect, few crystals present, but still visible, +: anti-crystallisation effect, very few crystals in wax, ++: very good anti-crystallisation effect, no crystals or no visible crystals present in the candle wax.

TABLE 1

Overview of the anti-crystallisation effect by the addition of polymer to the candle wax base. Hexadexyl/oxadecyl x/y: (x) represents the weight ratio of the palmityl group (hexadecyl) and (y) represents the weight ratio of the stearyl group (octadecyl) of the whole polymer. A, B and C represents the weight ratio of the amount of fatty acids which can be found in the candle wax base of $C_{16}$ hexadecanoic acid % $C_{18}$ octadecanoic acid % respectively.

| | | | | A | B | C |
|---|---|---|---|---|---|---|
| | C16 hexadecanoic acid | | % | 60-67 | 48-52 | 35-41 |
| | C18 octadecanoic acid | | % | 27-36 | 46-51 | 55-60 |
| | Titer | | ° C. | 53-56 | 55-56 | 56-58 |
| | Polymer additive | | C ppm | | | |
| 0 | / | | | −− | −− | +/− |
| | Hexadecyl/Octadecyl 5/95 | | | | | |
| 1 | Poly (vinyl alkyl ether) | Mw(A): 7 kDa | 200 | − | −− | ++ |
| 2 | Poly (vinyl alkyl ether) | Mw(A): 70 kDa | 200 | − | −− | ++ |
| 3 | Poly (vinyl alkyl ether) | Mw(A): 350 kDa | 200 | − | − | ++ |
| | Hexadecyl/Octadecyl 50/50 | | | | | |
| 4 | Poly (vinyl alkyl ether) | Mw(A): 7 kDa | 200 | − | −− | ++ |
| 5 | Poly (vinyl alkyl ether) | Mw(A): 75 kDa | 200 | +/− | − | ++ |
| 6 | Poly (vinyl alkyl ether) | Mw(A): 320 kDa | 200 | +/− | +/− | ++ |
| | Hexadecyl/Octadecyl 70/30 | | | | | |
| 8 | Poly (vinyl alkyl ether) | Mw(A): 7 kDa | 200 | + | − | ++ |
| 9 | Poly (vinyl alkyl ether) | Mw(A): 75 kDa | 200 | ++ | + | ++ |
| 10 | Poly (vinyl alkyl ether) | Mw(A): 320 kDa | 200 | ++ | + | ++ |
| | Hexadecyl/Octadecyl 70/30 | | | | | |
| 11 | Poly (vinyl alkyl ether) | Mw(A): 75 kDa | 200 | ++ | + | ++ |
| 12 | Poly (vinyl alkyl ether) | Mw(A): 75 kDa | 500 | ++ | ++ | ++ |
| 13 | Poly (vinyl alkyl ether) | Mw(A): 75 kDa | 1000 | ++ | ++ | ++ |
| | Hexadecyl/Octadecyl 70/30 | | | | | |
| 14 | Poly (vinyl alkyl ether - alkyl acrylate copolymer) | Mw(A): 100 kDa | 300 | ++ | ++ | ++ |
| 15 | Poly (vinyl alkyl ether - maleic anhydride copolymer) | Mw(A): 100 kDa | 300 | ++ | + | + |
| 16 | Poly (vinyl alkyl ether - (di)alkyl maleate copolymer) | Mw(A): 100 kDa | 300 | ++ | ++ | ++ |
| 17 | Poly (vinyl alkyl ether - (di)alkyl maleate - vinyl trialkoxysilane copolymer) | Mw(A): 100 kDa | 300 | ++ | ++ | ++ |
| 18 | Poly (vinyl alkyl ether - vinyl tri-alkoxysilane copolymer) | Mw(A): 100 kDa | 300 | ++ | ++ | ++ |
| 19 | Poly (vinyl acetate - (di)alkyl maleate copolymer) | Mw(A): 100 kDa | 300 | ++ | + | + |
| 20 | Poly (vinyl acetate - (di)alkyl maleate - trialkoxysilane copolymer | Mw(A): 100 kDa | 300 | ++ | + | + |
| 21 | Polystyrene - (di)alkyl maleate copolymer | Mw(A): 100 kDa | 300 | + | + | + |
| 22 | Poly (alkanoyl ethylene-imine) | Mw(A): 100 kDa | 300 | ++ | ++ | ++ |
| 24 | Poly (alkyl acrylamide) | Mw(A): 100 kDa | 300 | + | + | + |
| 25 | Poly (ethylene - (di)alkyl maleate copolymer) | Mw(A): 100 kDa | 300 | ++ | ++ | ++ |
| 26 | Poly (propylene - (di)alkyl maleate copolymer) | Mw(A): 100 kDa | 300 | ++ | ++ | ++ |
| 27 | Poly (butylene (di)alkyl maleate copolymer) | Mw(A): 100 kDa | 300 | ++ | ++ | ++ |
| 28 | poly (ethylene - (di)alkyl maleamide copolymer) | Mw(A): 100 kDa | 300 | + | + | + |
| 29 | poly (propylene - (di)alkyl maleamide copolymer) | Mw(A): 100 kDa | 300 | + | + | + |
| 30 | poly (butylene - (di)alkyl maleamide copolymer) | Mw(A): 100 kDa | 300 | + | + | + |

The invention claimed is:

1. A candle wax, the candle wax comprising:

a mixture of a candle wax base and a polymer, wherein the polymer comprises units having formula (I):

(I)

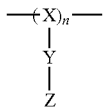

wherein:

X is an alkyl or alkylene-imine;

Y is —C(=O)NH—, or —O— for the case that the X is alkyl, or —(C=O)— for the case that the X is alkyl imine;

Z is an unbranched $C_{10}$ to $C_{40}$ alkyl group; and n is a positive integer;

wherein the polymer is a random copolymer with first units and second units, wherein the first units comprise a group Z different from the second unit.

2. The candle wax as claimed in claim 1, wherein Z in the first unit comprises a palmityl group (C16) and Z in the second unit comprises a stearyl group (C18).

3. The candle wax as claimed in claim 1, wherein the first unit is present in an amount of 50-95% by weight and the second unit is present in an amount of 5-50% by weight.

4. The candle wax according to claim 1, wherein X is produced from a monomer chosen from the group consisting of ethylene, 1-propylene, 2-propylene, 1-methyl-2-propylene, 2-methyl-2-propylene, 1-methyl-2-propylene, 1-butylene, 2-butylene, 3-butylene.

5. The candle wax according to claim 1, wherein Y is O.

6. The candle wax according to claim 5, wherein Y—Z comprises a $C_{14}$-$C_{22}$ alkyl ether.

7. The candle wax according to claim 6, wherein the polymer comprises a structure according to the formula (IV):

(IV)

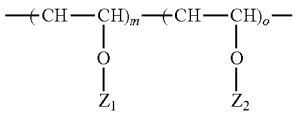

wherein Z1 is a C16 unbranched n-hexadecyl group and Z2 is a C18 unbranched n-octadecyl group, and wherein in and o are positive integers and the sum of in and o is greater than 3.

8. The candle wax according to claim 1, wherein Y is —C(=O)NH—.

9. The candle wax according to claim 1, wherein the polymer further comprises vinyl trialkoxysilane groups.

10. The candle wax according to claim 1, wherein the polymer is a random copolymer with a structure according to formula (IIa), having a first unit (A) and a second unit (B)

(IIa)

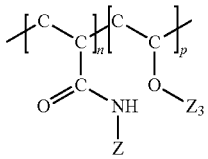

(A) (B)

wherein:

Z and $Z_3$ are chosen from the group of unbranched $C_{14}$, $C_{16}$, $C_{18}$, $C_{20}$ and $C_{22}$ alkyl groups; and n and p are positive integers and the sum of n and p is greater than 3.

11. A candle comprising a candle wax according to claim 1.

12. The candle wax according to claim 1, wherein the candle wax base comprises fatty acids in an amount of more than 90%.

13. The candle wax according to claim 1, wherein n is greater than 3.

14. The candle wax according to claim 1, wherein the polymer comprises monomeric units described by the formula:

(Ib)

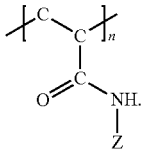

15. The candle wax according to claim 1, wherein the polymer comprises monomeric units described by the formula:

(Ia)

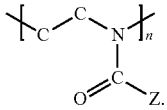

* * * * *